US009099794B2

(12) United States Patent
Ito et al.

(10) Patent No.: US 9,099,794 B2
(45) Date of Patent: Aug. 4, 2015

(54) CRIMP TERMINAL

(71) Applicant: YAZAKI CORPORATION, Minato-ku, Tokyo (JP)

(72) Inventors: Yoshitaka Ito, Shizuoka (JP); Takaya Kondou, Shizuoka (JP); Masanori Onuma, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/243,133

(22) Filed: Apr. 2, 2014

(65) Prior Publication Data

US 2014/0213123 A1 Jul. 31, 2014

Related U.S. Application Data

(63) Continuation of application No. PCT/JP2012/075124, filed on Sep. 28, 2012.

(30) Foreign Application Priority Data

Oct. 5, 2011 (JP) ..... 2011-220776

(51) Int. Cl.
*H01R 4/18* (2006.01)

(52) U.S. Cl.
CPC ..... *H01R 4/188* (2013.01)

(58) Field of Classification Search
CPC ..... H01R 4/185; H01R 4/188
See application file for complete search history.

(56) References Cited

U.S. PATENT DOCUMENTS 8,177,591 B2 * 5/2012 Okamura et al. ..... 439/877
8,246,394 B2 * 8/2012 Ono et al. ..... 439/877
8,303,354 B2 * 11/2012 Ootsuka et al. ..... 439/877
8,337,262 B2 * 12/2012 Ono et al. ..... 439/877
8,430,700 B2 * 4/2013 Ono et al. ..... 439/877
8,485,853 B2 * 7/2013 Seifert et al. ..... 439/882
8,622,774 B2 * 1/2014 Seifert et al. ..... 439/882
8,804,134 B2 * 8/2014 Onuma ..... 356/614

(Continued)

FOREIGN PATENT DOCUMENTS

JP 2010003467 A 1/2010
JP 2010061870 A 3/2010

(Continued)

OTHER PUBLICATIONS

Japanese office action letter issued on Apr. 14, 2015 in the counterpart Japanese patent application.

*Primary Examiner* — Ross Gushi
(74) *Attorney, Agent, or Firm* — Marvin A. Motsenbocker; Mots Law, PLLC

(57) ABSTRACT

Concave serrations are provided in an inner surface of a conductor crimping portion of a crimp terminal. A number of circular concave portions are provided in the inner surface of the conductor crimping portion as the concave serrations so as to be scattered in a state of being spaced aside from one another. A diameter of an inner bottom surface of each circular concave portion is set within a range of 0.15 (an error range is ±0.04) mm to 0.8 (the error range is ±0.04) mm. A serration angle between an extension surface of the inner bottom surface and an inner side surface of each circular concave portion is set within a range of 60 to 90 degrees. A shortest distance of a flat surface portion between peripheries of mutually adjacent circular concave portions is set to be 0.17 (the error range is ±0.09) mm.

2 Claims, 11 Drawing Sheets

(56) References Cited

U.S. PATENT DOCUMENTS

| | | | | |
|---|---|---|---|---|
| 8,814,611 | B2 * | 8/2014 | Onuma et al. | 439/877 |
| 8,814,612 | B2 * | 8/2014 | Onuma et al. | 439/877 |
| 8,858,275 | B2 * | 10/2014 | Onuma et al. | 439/877 |
| 2003/0013353 | A1 * | 1/2003 | Sakaguchi et al. | 439/877 |
| 2011/0009014 | A1 * | 1/2011 | Ono et al. | 439/877 |
| 2011/0124247 | A1 * | 5/2011 | Okamura et al. | 439/877 |
| 2013/0115828 | A1 * | 5/2013 | Seifert et al. | 439/877 |
| 2013/0130570 | A1 * | 5/2013 | Onuma et al. | 439/882 |
| 2014/0004757 | A1 * | 1/2014 | Matsushita et al. | 439/877 |
| 2014/0004758 | A1 * | 1/2014 | Kondou et al. | 439/877 |
| 2014/0004759 | A1 * | 1/2014 | Kondou et al. | 439/878 |
| 2014/0106628 | A1 * | 4/2014 | Sato | 439/877 |
| 2014/0206244 | A1 * | 7/2014 | Kato | 439/878 |
| 2014/0213123 | A1 * | 7/2014 | Ito et al. | 439/877 |
| 2014/0227916 | A1 * | 8/2014 | Kato et al. | 439/877 |
| 2015/0072573 | A1 * | 3/2015 | Kawamura et al. | 439/867 |

FOREIGN PATENT DOCUMENTS

| | | | |
|---|---|---|---|
| JP | 2010198776 | A | 9/2010 |
| JP | 2010198789 | A | 9/2010 |

* cited by examiner (a)

(b)

(a)

(b)

(a)

(b)

(c)

(a)

(b)

(a)

(b)

(a)

(b)

CRIMP TERMINAL

CROSS REFERENCE TO RELATED APPLICATION

This is a continuation application based on PCT application No. PCT/JP2012/075124 filed on Sep. 28, 2012, which claims the benefit of priority from Japanese Patent Application No. 2011-220776 filed on Oct. 5, 2011, the entire contents of which are incorporated by reference herein.

BACKGROUND OF THE INVENTION

1. Field of the Invention

The present invention relates to an open-barrel type crimp terminal having concave serrations in an inner surface of a conductor crimping portion having a U-letter shaped cross section.

2. Description of the Related Art

Conventionally, a general crimp terminal is, for example, provided with an electrical connection portion, a conductor crimping portion, and a sheath crimping portion as shown in Patent Literature 1 (Japanese Patent Application Laid-Open Publication No. 2010-198776). The electrical connection portion is provided at a front in a longitudinal direction of the terminal (in a same direction as a longitudinal direction of a conductor of an electrical wire connected to the terminal), and is connected to a terminal of a mating connector. The conductor crimping portion is provided closer to a rear than the electrical connection portion in the longitudinal direction of the terminal, and is crimped to the conductor exposed at a terminal of the electrical wire. The sheath crimping portion is provided closer to the rear than the conductor crimping portion in the longitudinal direction of the terminal, and is crimped to an insulation-coated portion of the electrical wire.

The conductor crimping portion is formed to have a substantially U-letter shaped cross section. The conductor crimping portion has a bottom plate, and a pair of conductor crimping pieces that are extended upward from both left and right side edges of the bottom plate and that crimp the conductor of the electrical wire arranged on an inner surface of the bottom plate so as to wrap it. The sheath crimping portion is formed to have a substantially U-letter shaped cross section. The sheath crimping portion has a bottom plate, and a pair of sheath crimping pieces that are extended upward from the both left and right side edges of the bottom plate and that crimp the electrical wire (insulation-coated portion) arranged on the inner surface of the bottom plate so as to wrap it. In an inner surface of the conductor crimping portion, provided is a plurality of concave groove-shaped serrations that extend in a direction perpendicular to a direction where the conductor of the electrical wire extends (terminal longitudinal direction).

FIG. 1(*a*) shows an expanded shape of a conductor crimping portion of a crimp terminal of a conventional example. A conductor crimping portion 213 of a crimp terminal 200 is formed of a bottom plate 215, and a pair of conductor crimping pieces 213*a* and 213*a* that are extended upward from both left and right side edges of the bottom plate 215 and that crimp a conductor of an electrical wire arranged on an inner surface of the bottom plate 215 so as to wrap it. Although FIG. 1(*a*) shows the expanded shape of the conductor crimping portion, actually, the conductor crimping portion 213 is bent to have a substantially U-letter shaped cross section in an uncrimped state. In an inner surface of the conductor crimping portion 213, provided is a plurality of concave groove-shaped serrations 220 that extend in a direction perpendicular to a direction where the conductor of the electrical wire extends.

FIG. 1(*b*) is an arrow cross-sectional view taken along a line B-B of FIG. 1(*a*). A cross-sectional shape of the concave groove-shaped serration 220 is usually a rectangle or an inverted trapezoid. In the present description, an angle θ between an extension surface of an inner bottom surface and an inner side surface of the serration 220 is called a serration angle. This serration angle θ is generally set in a range of 45 to 90 degrees.

In order to pressure-bond the conductor crimping portion 213 of the crimp terminal 200 to the conductor (illustration is omitted) of a terminal of the electrical wire, the crimp terminal 200 is placed on a placement surface (top surface) of a lower mold (an anvil, illustration is omitted), and the conductor of the electrical wire is inserted between the pair of conductor crimping pieces 213*a* and 213*a* of the conductor crimping portion 213 to be placed on the top surface of the bottom plate 215. Then, an upper mold (clamper) is then lowered relatively to the lower mold, and thereby tip sides of the conductor crimping pieces 213*a* are gradually tilted inside the crimp terminal 200 in a guide inclined surface of the upper mold. When the upper mold (clamper) is further lowered relatively to the lower mold, the tips of the conductor crimping pieces 213*a* and 213*a* are rounded so as to be folded to a conductor side in a curved surface continuous to a central chevron portion from the guide inclined surface of the upper mold, and bite into the conductor of the electrical wire while rubbing against each other. Thereby, the conductor crimping pieces 213*a* and 213*a* are crimped so as to wrap the conductor therein. By the above operation, the conductor crimping portion 213 of the crimp terminal 200 can be connected to the conductor of the electrical wire by crimping. In this crimping, the conductor of the electrical wire gets into the serrations 220 of the inner surface of the conductor crimping portion 213 while causing a plastic deformation by a pressure force. Thereby, electrical and mechanical joining of the terminal 200 and the electrical wire is enhanced.

By the way, when a shape of the concave serration 220, particularly the serration angle θ significantly decreases (herein, change of this serration angle is also referred to as "angle deformation") by a pressure force at the time of crimping, a stress that is transmitted to an element wire of the conductor is reduced, thereby a serration function is not sufficiently exerted, and/or a relative sliding distance between the terminal and the conductor decreases, thereby an adhesion amount (a coupling amount of metal at a molecular or an atomic level) enough to sufficiently secure crimping performance can not be obtained. As a result of it, there is a problem of leading to deterioration of the crimping performance.

For example, as shown in FIG. 2(*a*), in a case of the conventional concave groove-shaped serrations 220, it has been confirmed that the serration angle significantly decreases as a compression rate becomes larger. In addition, although as shown in FIG. 2(*b*), a stress applied to the conductor increases as the compression rate becomes larger, it has been confirmed that an increase rate of the stress is considerably reduced in a case where angle deformation occurs as compared with a case where it does not occur.

Accordingly, in order to improve the crimping performance, it is important to make higher the stress working on the conductor and to increase an adhesion amount between the terminal and the conductor by crimping. In order to make the stress of the conductor higher and to increase the adhesion amount, it is necessary to sufficiently fulfill a serration function by suppressing the angle deformation of the serrations, and to increase a relative sliding distance between the terminal and the conductor.

SUMMARY OF THE INVENTION

The present invention aims at providing a crimp terminal that can suppress change of a serration angle (an angle between an extension surface of an inner bottom surface and an inner side surface of a concave serration) in a state after crimping in order to improve crimping performance by increasing a stress applied to a conductor of an electrical wire, and making longer a relative sliding distance between the terminal and the conductor.

According to a first aspect of the present invention, there is provided a crimp terminal including: an electrical connection portion provided at a front of the crimp terminal in a terminal longitudinal direction; and a conductor crimping portion that is provided closer to a rear than the electrical connection portion in the terminal longitudinal direction, and is crimped and connected to a conductor of a terminal of an electrical wire, wherein the conductor crimping portion is formed to have a substantially U-letter shaped cross section, the conductor crimping portion has a bottom plate, and a pair of conductor crimping pieces that are extended upward from both left and right side edges of the bottom plate and that crimp the conductor of the electrical wire arranged on an inner surface of the bottom plate so as to wrap the conductor of the electrical wire, concave serrations are provided in an inner surface of the conductor crimping portion, a number of circular concave portions are provided in the inner surface of the conductor crimping portion as the concave serrations so as to be scattered in a state of being spaced aside from one another, in a state before the conductor crimping portion is crimped to the conductor of the electrical wire, a diameter of an inner bottom surface of each circular concave portion is set within a range of 0.15 (the error range is ±0.04) mm to 0.8 (the error range is ±0.04) mm, a serration angle between an extension surface of the inner bottom surface and an inner side surface of the each circular concave portion is set within a range of 60 to 90 degrees, and a shortest distance of a flat surface portion between peripheries of mutually adjacent circular concave portions is set to be 0.17 (the error range is ±0.09) mm.

According to a second mode of the present invention, the diameter of the inner bottom surface of the each circular concave portion is set to be 0.3 (the error range is ±0.04) mm, the serration angle between the extension surface of the inner bottom surface and the inner side surface of the each circular concave portion is set to be 70 degrees, and the shortest distance of the flat surface portion between the peripheries of the mutually adjacent circular concave portions is set to be 0.15 mm.

According to the crimp terminal of the first aspect of the present invention, a number of circular concave portions are provided in the inner surface of the conductor crimping portion as the concave serrations so as to be scattered in a state of being spaced aside from one another. The diameter of each circular concave portion is set within the range of 0.15 (the error range is ±0.04) mm to 0.8 (the error range is ±0.04) mm. The serration angle between the extension surface of the inner bottom surface and the inner side surface of each circular concave portion is set within the range of 60 to 90 degrees. The shortest distance of the flat surface portion between the peripheries of the mutually adjacent circular concave portions is set to be 0.17 (the error range is ±0.09) mm. Therefore, a cross-sectional secondary moment of a portion in which the serrations are formed can be remarkably increased as compared with a case where serrations include rectangular concave portions or a case where they include grooves having rectangular cross sections. Accordingly, the cross-sectional secondary moment becomes higher, whereby tilt deformation of the inner side surfaces of the circular concave portions at the time of crimping, i.e., decrease of the serration angle (angle between the extension surface of the inner bottom surface and the inner side surface of each circular concave portion) in the state after crimping can be suppressed to be small, and catch of the peripheries and the inner side surfaces of the circular concave portions with the conductor in which plastic deformation is caused can be strengthened. As a result of it, the stress that acts on the conductor (an element wire) of the electrical wire can be increased as much as deformation of the terminal becomes smaller, and the relative sliding distance between the terminal and the conductor can be made longer to increase the adhesion amount of the terminal and the conductor, and thus the crimping performance (electrical and mechanical coupling performance) can be improved.

According to the crimp terminal of the second aspect of the present invention, the diameter of each circular concave portion is set to be 0.3 (the error range is ±0.04) mm. The serration angle between the extension surface of the inner bottom surface and the inner side surface of each circular concave portion is set to be 70 degrees. The shortest distance of the flat surface portion between the peripheries of the mutually adjacent circular concave portions is set to be 0.15 mm. Therefore, a cross-sectional secondary moment of serration portions can be effectively increased, and deformation of the serration angle in the state after crimping can be suppressed to be as small as possible. As a result of it, the stress that acts on the conductor (element wire) of the electrical wire can be increased, and the relative sliding distance between the terminal and the conductor can be made longer, and thus the crimping performance can be much more improved.

BRIEF DESCRIPTION OF THE DRAWINGS

FIG. 1(*b*) is an arrow cross-sectional view taken along a line B-B of FIG. 1(*a*).

FIG. 2(*b*) is a characteristic graph showing a relation between the compression rate and a stress that works on a conductor when comparing the case where the serration angle changes at the time of crimping with the case where it does not change.

FIG. 7(*b*) is a cross-sectional view of the small circular concave portions.

FIG. 7(*c*) is a perspective view of a calculation model of a cross-sectional secondary moment used for calculating the cross-sectional secondary moment of a serration portion of the conductor crimping portion according to the first embodiment of the present invention.

FIG. 8(*b*) is a perspective view of a calculation model of a cross-sectional secondary moment used for calculating the cross-sectional secondary moment of a serration portion of the conductor crimping portion according to the comparative example.

FIG. 9(*b*) is a diagram showing that a stress is unequally acting on a periphery of a rectangular concave portion.

FIG. 11(*b*) is an arrow cross-sectional view taken along a line A-A of FIG. 11(*a*).

DESCRIPTION OF THE EMBODIMENTS

Hereinafter, first to third embodiments of the present invention will be explained with reference to drawings.

First Embodiment

Figure 3:
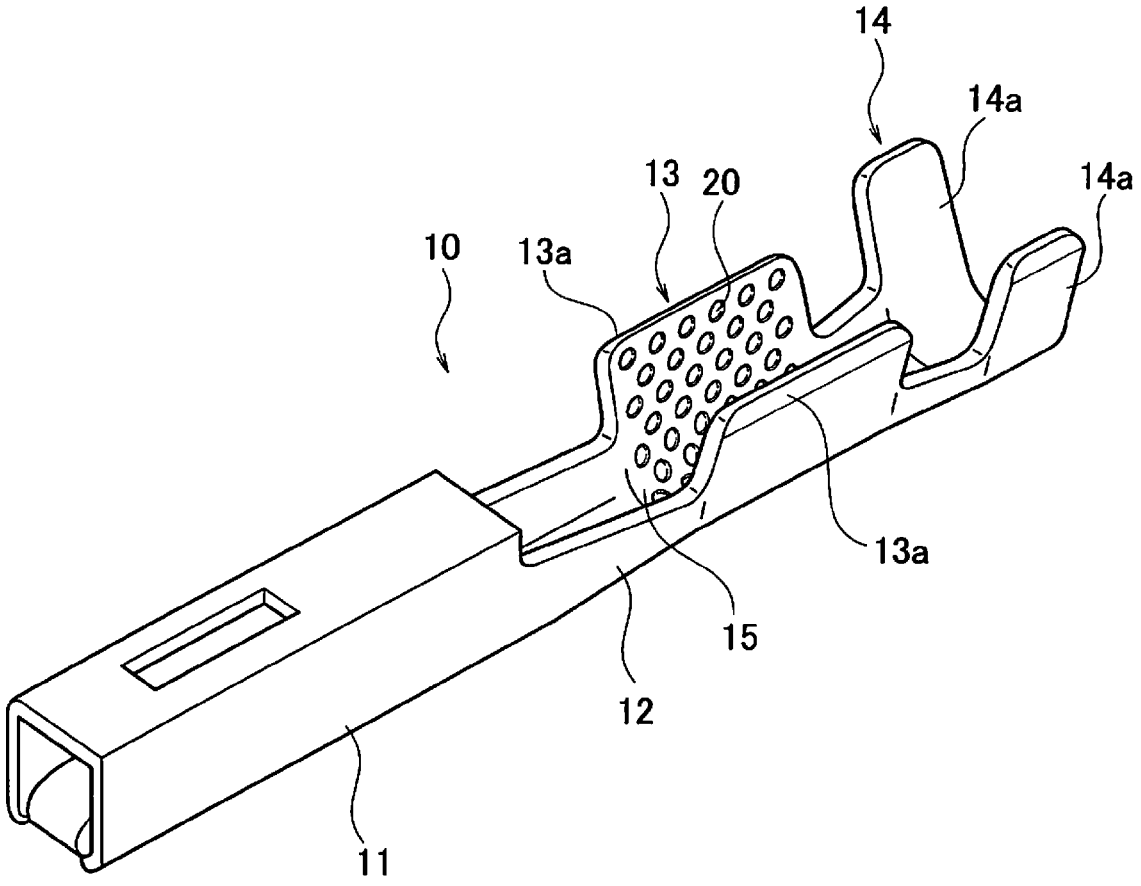
FIG. 3 is an external perspective view of a crimp terminal according to a first embodiment of the present invention.
Figure 4:
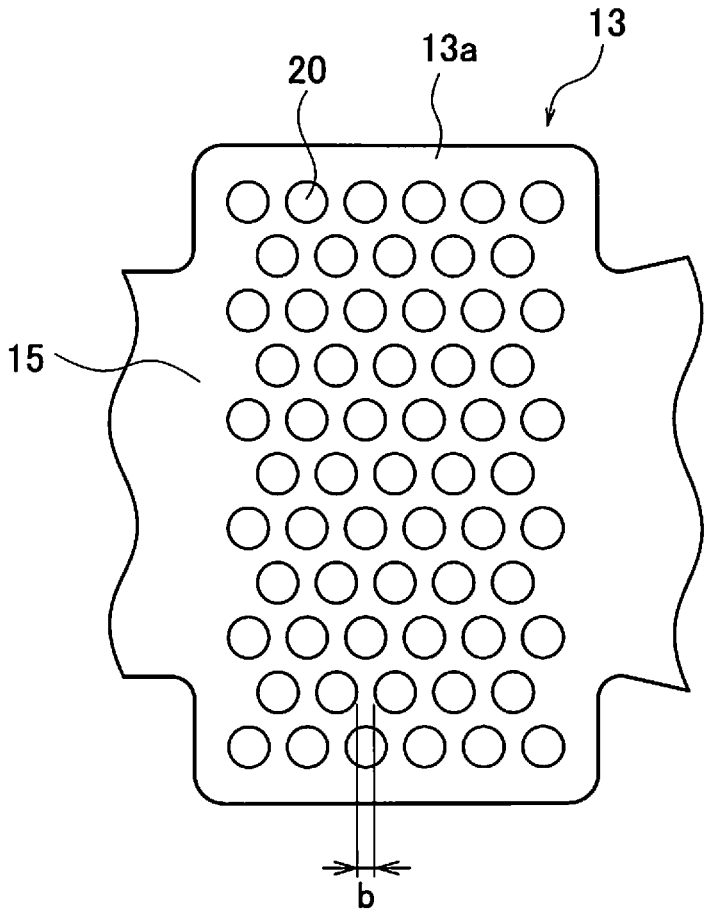
FIG. 4 is a plan view showing an expanded shape of a conductor crimping portion of the crimp terminal according to the first embodiment of the present invention.
Figure 5:
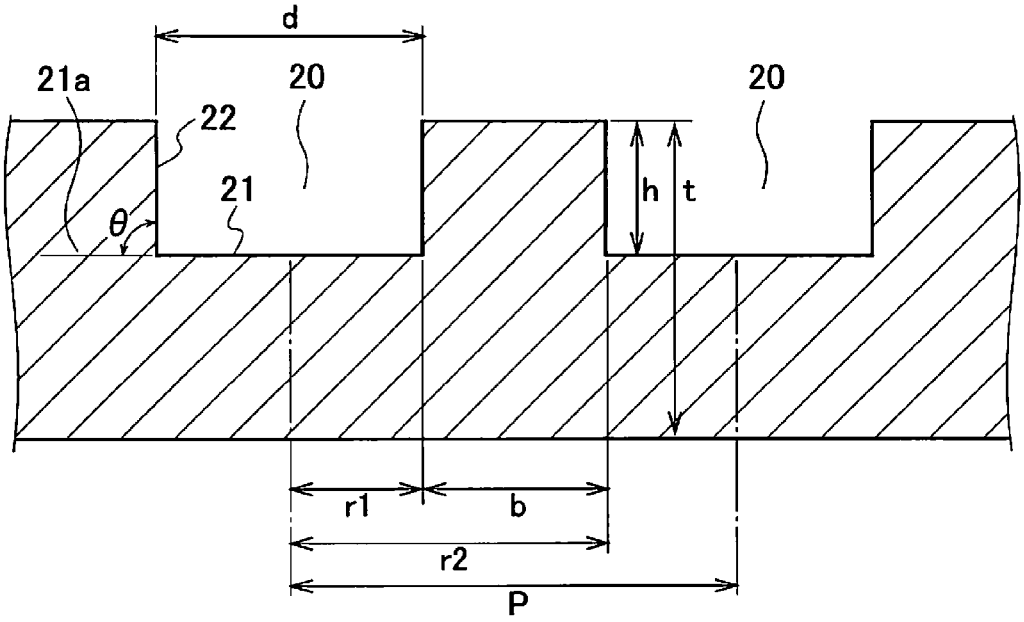
FIG. 5 is an enlarged cross-sectional view of small circular concave portions in a state before crimping of the conductor crimping portion according to the first embodiment of the present invention (in a case where a serration angle $\theta=90$ degrees).
Figure 6:
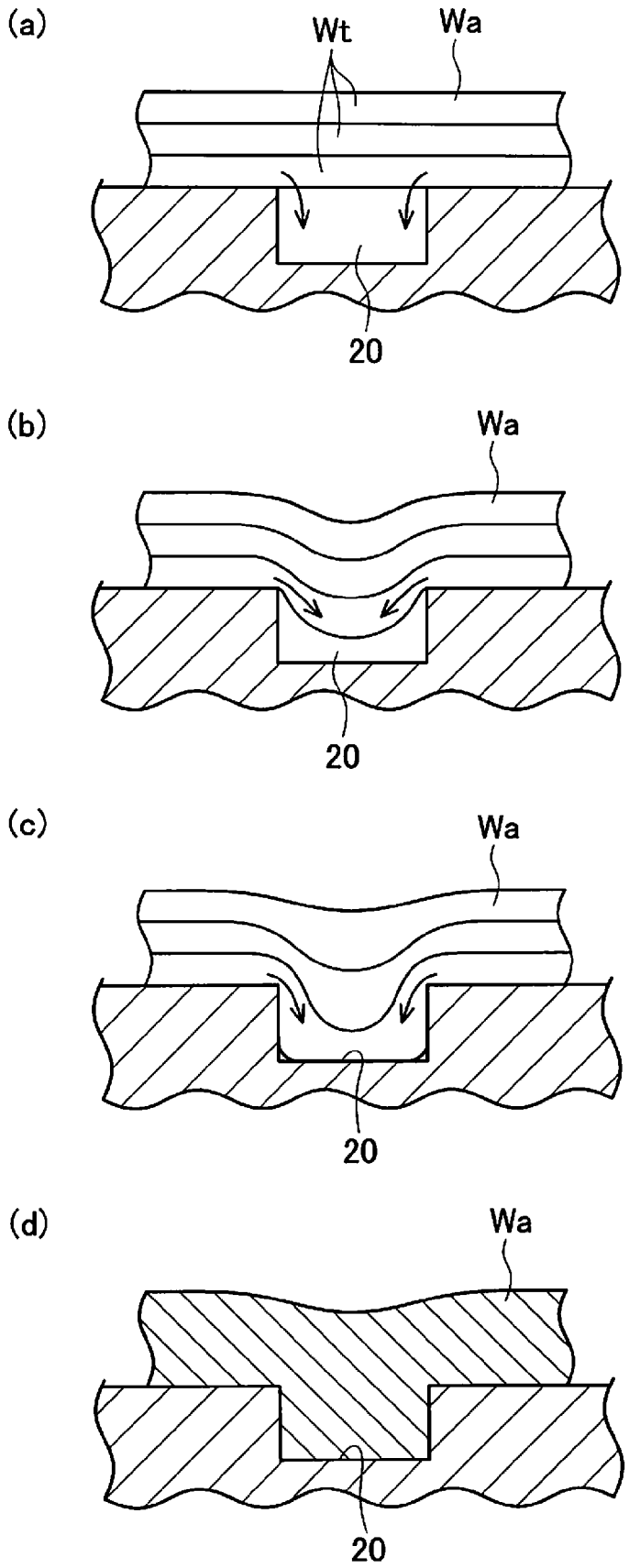
FIGS. 6(*a*) to 6(*d*) are enlarged cross-sectional views schematically and sequentially showing a condition in which a conductor gets into the small circular concave portion of the conductor crimping portion while causing a plastic deformation at the time of crimping.

FIG. 3 is an external perspective view of a crimp terminal. FIG. 4 is a plan view showing an expanded shape of a conductor crimping portion of the crimp terminal. FIG. 5 is an enlarged cross-sectional view of small circular concave portions in a state before crimping of the conductor crimping portion. FIGS. 6(*a*) to 6(*d*) are enlarged cross-sectional views schematically and sequentially showing a condition in which a conductor gets into the small circular concave portion of the conductor crimping portion while causing a plastic deformation at the time of crimping.

Figure 1:
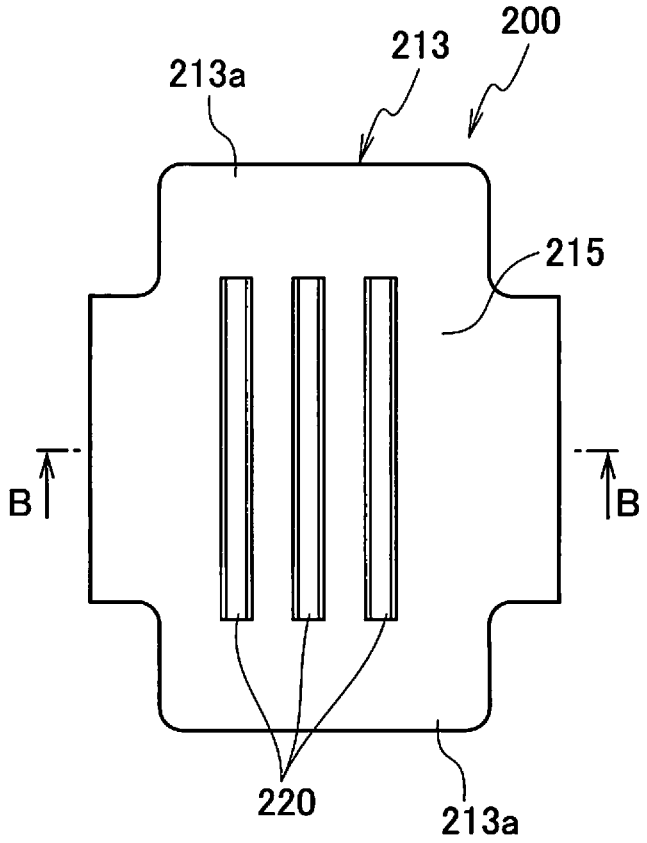
FIG. 1 PRIOR ART
FIG. 1(*a*) is a plan view showing an expanded shape of a conductor crimping portion of a conventional crimp terminal.
Figure 1:
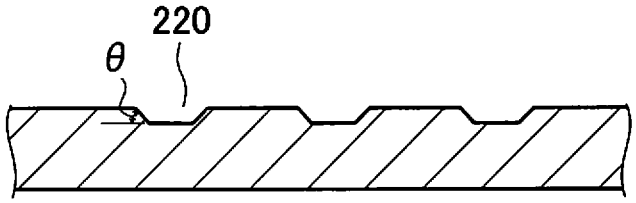
FIG. 1 PRIOR ART
Figure 2:
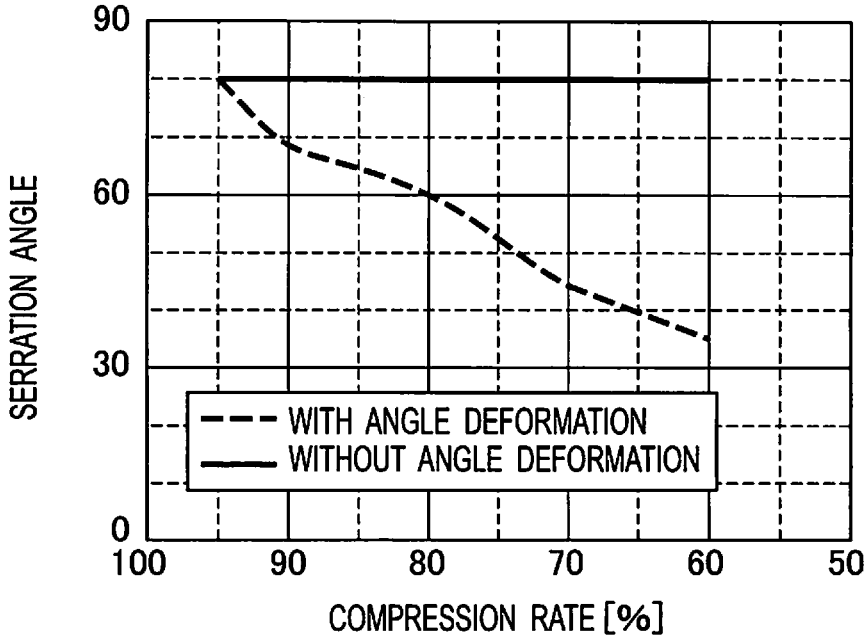
FIG. 2 PRIOR ART
FIG. 2(*a*) is a characteristic graph showing a relation between a compression rate and a serration angle when comparing a case where the serration angle changes at the time of crimping with a case where it does not change.
Figure 2:
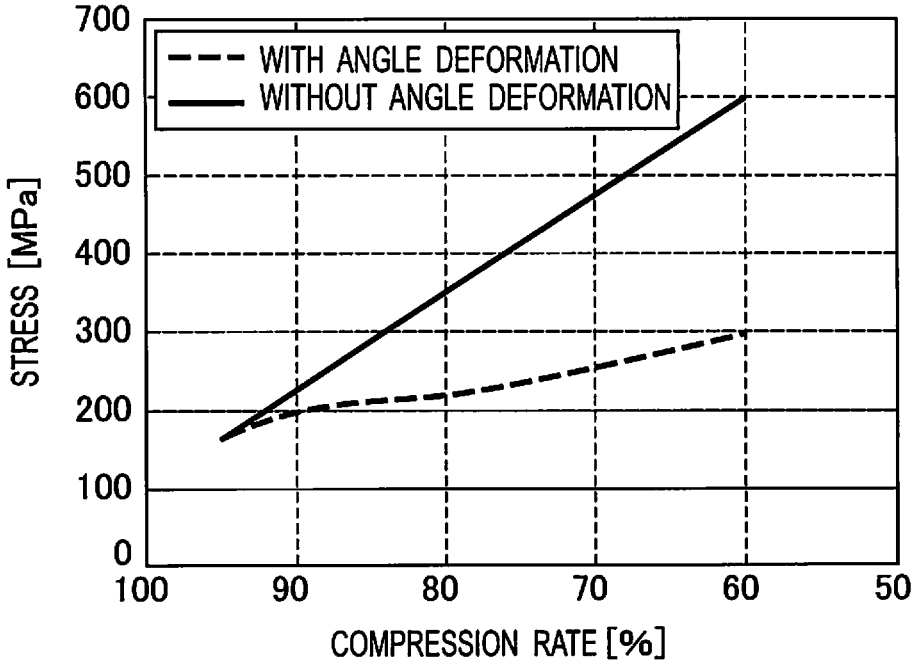
FIG. 2 PRIOR ART

As shown in FIG. 1, a crimp terminal 10 is a female terminal and includes an electrical connection portion 11, a link portion 12, a conductor crimping portion 13 and a sheath crimping portion 14. The box-type electrical connection portion 11 is provided at a front in a longitudinal direction of the terminal (in a longitudinal direction of a conductor of an electrical wire connected to the terminal, i.e., in a direction where the electrical wire extends), and is connected to a male terminal of a mating connector. The conductor crimping portion 13 is provided closer to a rear than the electrical connection portion 11 in the longitudinal direction of the terminal, and is crimped to a conductor Wa (refer to FIG. 6) exposed at a terminal of the electrical wire (illustration is omitted). The sheath crimping portion 14 is provided closer to the rear than the conductor crimping portion 13 in the longitudinal direction of the terminal, and is crimped to an insulation-coated portion of the electrical wire. The link portion 12 is provided between the electrical connection portion 11 and the conductor crimping portion 13, and links the electrical connection portion 11 to the conductor crimping portion 13.

The conductor crimping portion 13 is formed to have a substantially U-letter shaped cross section. The conductor crimping portion 13 has a bottom plate 15 that extends from the electrical connection portion 11 to the sheath crimping portion 14, and a pair of conductor crimping pieces 13*a* and 13*a* that are extended upward from both left and right side edges of the bottom plate 15 and that crimp the conductor of the electrical wire arranged on an inner surface of the bottom plate 15 so as to wrap it. The sheath crimping portion 14 has the bottom plate 15, and a pair of sheath crimping pieces 14*a* and 14*a* that are extended upward from the both left and right side edges of this bottom plate 15 and that crimp the electrical wire (insulation-coated portion) arranged on the inner surface of the bottom plate 15 so as to wrap it.

As shown in FIG. 4, a number of small circular concave portions 20 are provided in an inner surface (a surface of a side in contact with the conductor of the electrical wire) of the conductor crimping portion 13 as concave serrations so as to be scattered in zigzag in a state of being spaced aside from one another in a state before the conductor crimping portion 13 is crimped to the conductor Wa of the electrical wire.

As shown in FIG. 5, a cross-sectional shape of each small circular concave portion 20 is rectangular. Inner bottom surfaces 21 of the concave portions 20 are formed substantially in parallel with a surface in which the concave portions 20 of the conductor crimping portion 13 are not formed. The serrations (small circular concave portions 20) of the conductor crimping portion 13 are manufactured by performing press working with a metallic mold having a number of cylindrical convex portions corresponding to the concave portions 20. A round with an appropriate size is provided at inner peripheral corners in which inner side surfaces 22 of the concave portions 20 as the serrations intersect with the inner bottom surfaces 21, and at peripheries of the concave portions 20. It is to be noted that a material of the crimp terminal 10 is copper alloy etc., and that plating treatment etc. are applied on a surface of the material.

In addition, as shown in FIG. 5, a diameter "d" of each small circular concave portion 20 is set to be 0.3 (the error range is ±0.04) mm (i.e., the diameter is within 0.26 to 0.34 mm, and a radius r1 is within 0.13 to 0.17 mm). A depth "h" of each small circular concave portion 20 is set to be 0.05 (the error range is ±0.02) mm. A serration angle θ between an extension surface 21*a* of the inner bottom surface 21 and the inner side surface 22 of each small circular concave portion 20 is set to be within 60 to 90 degrees (90 degrees in the present embodiment). In addition, a shortest distance "b" of a flat surface portion between peripheries of mutually adjacent small circular concave portions 20 is set to be 0.17 (the error range is ±0.09) mm (i.e., 0.08 to 0.26 mm). A pitch "P" of the small circular concave portions 20 (a distance between center lines of the adjacent concave portions 20) is set to be 0.47 (the error range is ±0.05) mm (i.e., 0.42 to 0.52 mm).

In order to crimp the conductor crimping portion 13 of the crimp terminal 10 to the conductor Wa (refer to FIG. 6) of the terminal of the electrical wire, the crimp terminal 10 is placed on a placement surface (top surface) of a lower mold (an anvil, illustration is omitted), and the conductor Wa of the terminal of the electrical wire is inserted between the conductor crimping pieces 13*a* of the conductor crimping portion 13 to be placed on a top surface (an inner surface that serves as an inside when rounded) of the bottom plate 15. The conductor Wa of the electrical wire in this case is formed as a wire rod by twisting a number of element wires Wt. A material of the conductor Wa is copper or aluminum (including alloy) etc.

An upper mold (clamper) is lowered relatively to the lower mold in a state where the conductor Wa is set to the lower mold, and thereby tip sides of the pair of conductor crimping pieces 13*a* and 13*a* are gradually tilted inside in a guide inclined surface of the upper mold. When the upper mold (clamper) is further lowered relatively to the lower mold, the tips of the conductor crimping pieces 13*a* and 13*a* are rounded so as to be folded to a conductor side in a curved surface continuous to a central chevron portion from the guide inclined surface of the upper mold, and bite into the conductor Wa of the electrical wire while rubbing against each other. Thereby, the conductor crimping pieces 13*a* and 13*a* are crimped so as to wrap the conductor Wa therein.

By the above operation, the conductor crimping portion 13 of the crimp terminal 10 can be connected to the conductor Wa of the electrical wire by crimping. Similarly to the sheath crimping section 14, the sheath crimping pieces 14*a* and 14*a* are gradually bent inside using the lower mold and the upper mold, and the sheath crimping pieces 14*a* and 14*a* are crimped to the insulation-coated portion of the electrical wire. Thereby, the crimp terminal 10 can be electrically and mechanically connected to the electrical wire.

By the way, in a process of crimping of the conductor crimping portion 13, as shown in FIGS. 6(*a*) to 6(*d*), the conductor Wa gets into the small circular concave portion 20 while causing a plastic deformation, and the conductor Wa fills the concave portion 20 while smoothly flowing along the inner surface of the concave portion 20. In so doing, a pressure force is applied to both the conductor Wa and the terminal 10, whereby a contact pressure to the periphery of the concave portion 20 by the conductor Wa becomes gradually higher as the pressure force increases, and a force due to the contact pressure acts to deform the periphery of the concave portion 20 outside. When the periphery of the concave portion 20 largely deforms outside by this force, the inner side surface 22 of the concave portion 20 tilts outside, and the serration angle θ largely decreases. As a result of this, an increase rate of a stress applied to the conductor Wa according to a compression rate (a decrease rate of a cross-sectional area of the crimping portion by crimping) is reduced, and a relative sliding distance between the conductor Wa and the terminal 10 becomes smaller.

In contrast to this, since in the present embodiment, the concave portion 20 is formed as a circle in a planar view, and a size of the concave portion 20 and a size of the periphery thereof are set as described above, rigidity of a portion in which the concave portion 20 is provided is remarkably enhanced as compared with the conventional concave groove-shaped serration. Deformation of the concave portion 20, particularly deformation of the serration angle θ is thereby suppressed.

Figure 7:
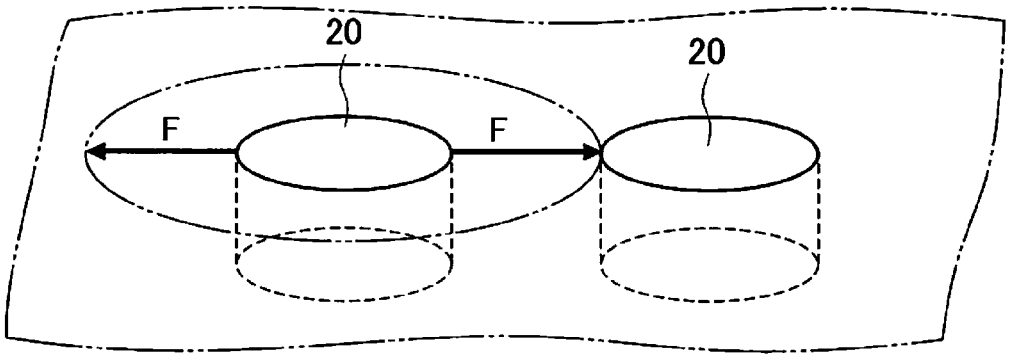
FIG. 7(*a*) is a partial enlarged perspective view of a conductor crimping portion in which small circular concave portions are provided.
Figure 7:
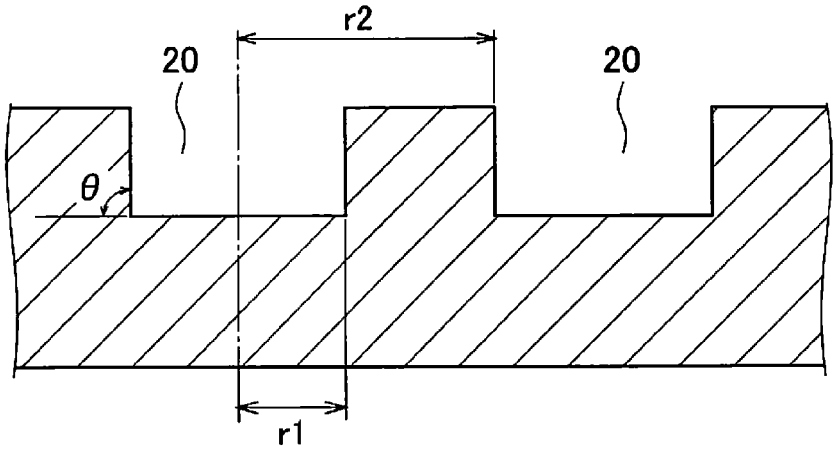
Figure 7:
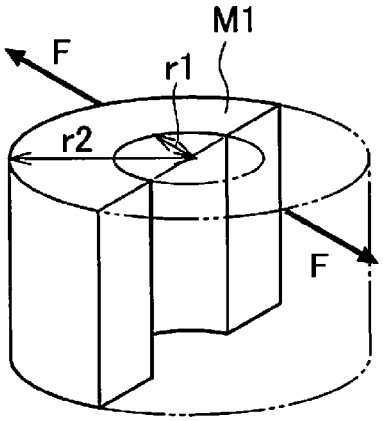

Hereinafter, this point will be examined. As shown in FIG. 7(*a*), by the pressure force at the time of crimping, for example, a force F acts to the small circular concave portion 20 (it may be called a circular serration or a round serration) in a direction where the serration angle θ of the concave portion 20 is decreased. Considering rigidity of a peripheral wall portion of the concave portion 20 when the force F works, the peripheral wall portion of the concave portion 20 can be regarded as a semicylindrical model M1. Consequently, a cross-sectional secondary moment in the model M1 will be calculated.

The cross-sectional secondary moment I of a semicylindrical member can be obtained from a next formula (Expression 1).

$$I=0.1098(r2^4-r1^4)-0.283r2^2\cdot r1^2(r2-r1)/(r2+r1) \quad \text{[Expression 1]}$$

Here, r1 is a radius of the small circular concave portion 20, and is an inner diameter of a member having a semicircular arc cross section. In addition, r2 is a size obtained by adding a length "b" of a flat surface portion to r1, and is an outer diameter of a member having a semicylindrical cross section.

Results of having calculated the cross-sectional secondary moment for some size examples are as shown in the following Table 1. Size groups whose evaluations are ○ are included in the present invention, and a size group whose evaluation is X is excluded from the scope of the present invention.

TABLE 1

| Evaluation | Length of Flat Surface Portion (mm) | Radius (mm) | Cross-sectional Secondary Moment ($mm^4$) |
|---|---|---|---|
| ○ | 0.26 | 0.13 | $2.15 \times 10^{-3}$ |
| ○ | 0.18 | 0.17 | $1.21 \times 10^{-3}$ |
| ○ | 0.16 | 0.13 | $5.92 \times 10^{-4}$ |
| ◎ | 0.15 | 0.15 | $6.43 \times 10^{-4}$ |
| ○ | 0.08 | 0.17 | $2.40 \times 10^{4}$ |
| X | 0.05 | 0.18 | $1.33 \times 10^{4}$ |

Figure 8:
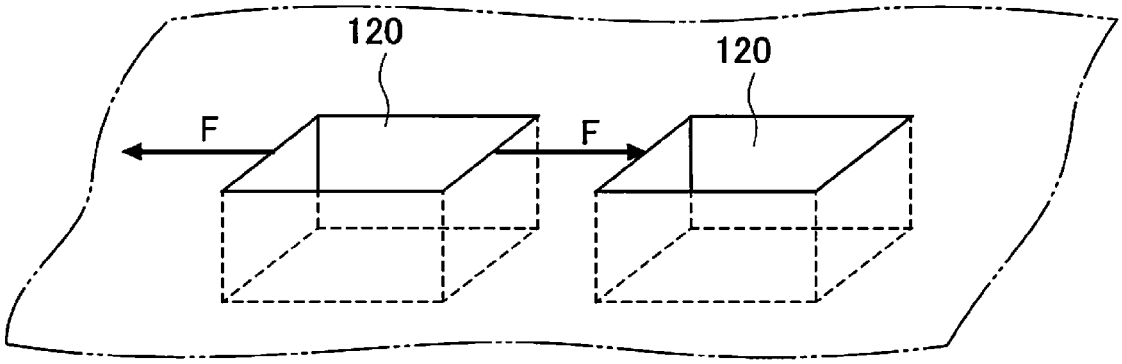
FIG. 8(*a*) is a partial enlarged perspective view of a conductor crimping portion in which rectangular concave portions are provided according to a comparative example.
Figure 8:
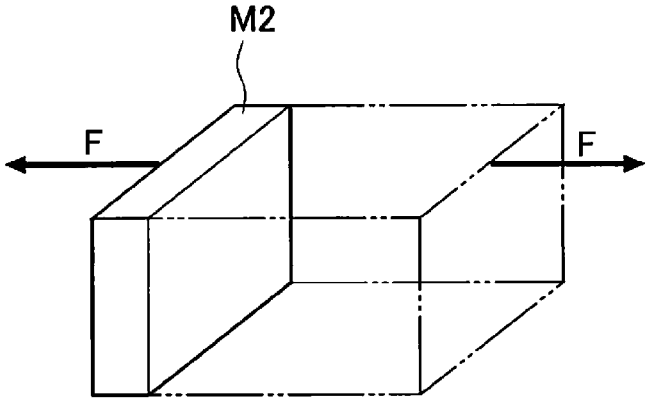

Meanwhile, as a comparative example, as shown in FIG. 8(*a*), calculated was a cross-sectional secondary moment when rectangular concave portions 120 were provided as the concave serrations. In this case, as shown in FIG. 8(*b*), a portion receiving a pressure force can be regarded as a model M2 of a planar wall. In this model M2, a cross-sectional secondary moment I is established as follows from a formula (Expression 2).

$$I=bh^3/12 \quad \text{[Expression 2]}$$

Here, "b" is a width size of the planar wall, and "h" is a depth size.

For example, when a case of b=0.3 mm and h=0.15 mm is calculated as values approximate to a size group of ◎ evaluation in the above-described Table 1, a result of $I=8.44\times10^{-5}$ $mm^4$ is obtained. When compared with the case of the small circular concave portion 20 of ◎ evaluation, a size of the cross-sectional secondary moment of the rectangular concave portion 120 is different from that of the cross-sectional secondary moment of the small circular concave portion 20 by one digit. That is, when compared with the case of the rectangular concave portion 120, remarkably large cross-sectional secondary moment can be obtained by providing the small circular concave portion 20 as the serration.

According to the crimp terminal 10, the following effects can be obtained.

A number of small circular concave portions 20 are provided in the inner surface of the conductor crimping portion 13 as the concave serrations so as to be scattered in a state of being spaced aside from one another. The diameter of each small circular concave portion 20 is set to be 0.3 (the error range is ±0.04) mm. The serration angle θ between the extension surface 21*a* of the inner bottom surface 21 and the inner side surface 22 of each small circular concave portion 20 is set to be within 60 to 90 degrees. The shortest distance "b" of the flat surface portion between the peripheries of the mutually adjacent small circular concave portions 20 is set to be 0.17 (the error range is ±0.09) mm. By such a configuration, the cross-sectional secondary moment of the portion in which the serrations are formed can be remarkably increased as compared with the case where the serrations include the rectangular concave portions, or the case where they are formed as the grooves having the rectangular cross sections.

The cross-sectional secondary moment of the portion in which the serrations are formed becomes higher, whereby tilt deformation of the inner side surfaces 22 of the small circular concave portions 20 at the time of crimping, i.e., decrease of the serration angle θ (angle between the extension surface of the inner bottom surface and the inner side surface of each small circular concave portion) in a state after crimping can be suppressed to be small, and catch of the peripheries and the inner side surfaces 22 of the small circular concave portions 20 with the conductor Wa in which a plastic deformation is caused can be strengthened. As a result of it, since deformation of the terminal 10 becomes smaller, the stress that acts on the conductor Wa (an element wire Wt) of the electrical wire can be increased, and a relative sliding distance between the terminal 10 and the conductor Wa can be made longer to increase an adhesion amount of the terminal 10 and the conductor Wa, which improves crimping performance (electrical and mechanical coupling performance).

Figure 9:
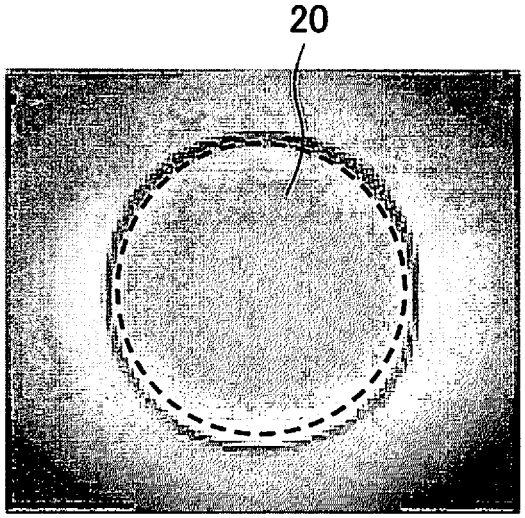
FIG. 9(*a*) is a diagram showing that a stress is equally acting on an entire periphery of a small circular concave portion.
Figure 9:
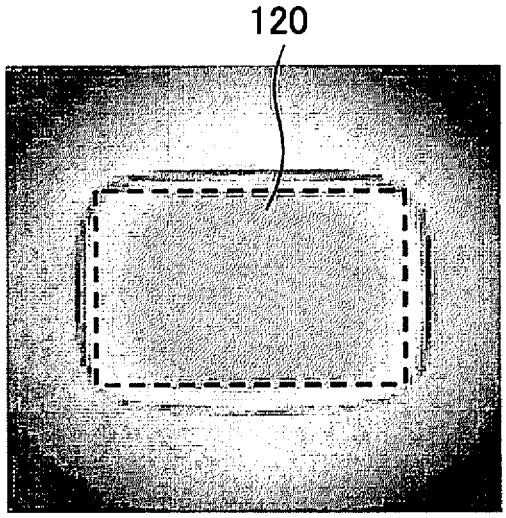
Figure 10:
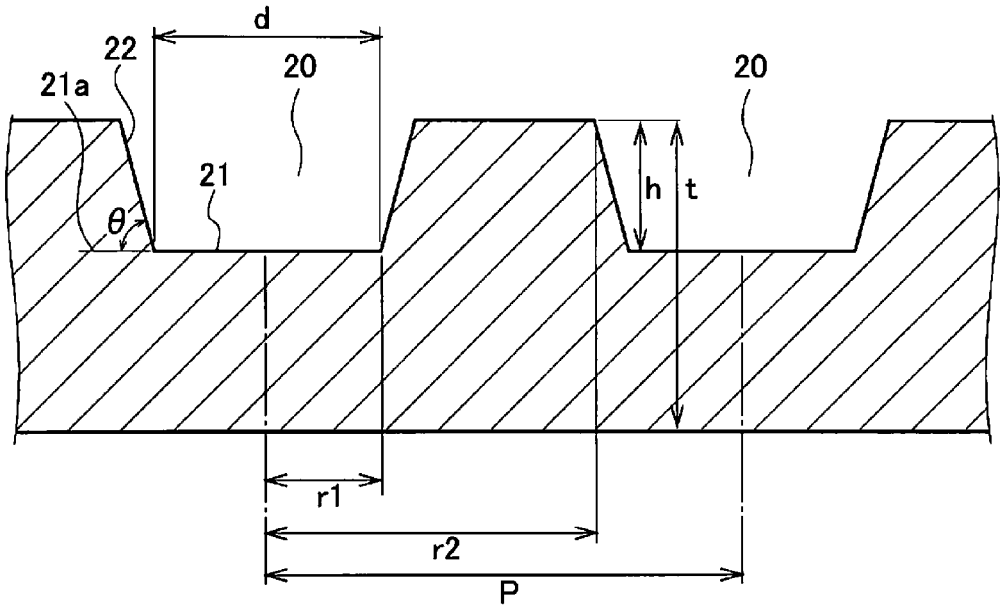
FIG. 10 is an enlarged cross-sectional view of small circular concave portions in a crimp terminal according to a second embodiment of the present invention (in a case where a serration angle θ=70 degrees).

FIG. 9 is comparison diagrams of stresses that work on a circular concave portion and a rectangular concave portion. Specifically, FIG. 9(*a*) is the diagram showing that the stress is equally acting on an entire periphery of the circular concave portion, and FIG. 9(*b*) is the diagram showing that the stress is unequally acting on a periphery of the rectangular concave portion. As shown in FIG. 9, since the stress equally acts on the entire periphery around the concave portion 20 in the case of the circular concave portion 20, the entire periphery can resist the stress, and deformation can be suppressed to be small. Since the stress strongly concentrates on a center of each line of the rectangular concave portion 120 in the case of the rectangular concave portion 120, the concentrated portion easily deforms.

Next, will be examined a maximum diameter (largest diameter) and a minimum diameter (smallest diameter) of the small circular concave portion 20, the plural rows of small circular concave portions 20 being able to be arranged in the inner surface of the conductor crimping portion 13 as the concave serrations.

Table 2 represents numerical values of cross-sectional secondary moment when the diameter of each small circular concave portion 20 is within 1 (the error range is ±0.04) mm to 0.05 (the error range is ±0.04) mm. Table 3 represents numerical values of cross-sectional secondary moment when a diameter of the concave portion 120 having a rectangular shape in a planar view is within 1 (the error range is ±0.04) mm to 0.05 (the error range is ±0.04) mm, the numerical values corresponding to those in Table 2.

TABLE 2

| Evaluation | Length of Flat Surface Portion (mm) | Radius (mm) | Cross-sectional Secondary Moment ($mm^4$) |
|---|---|---|---|
| X | 0.15 | 0.5 | $8.84 \times 10^{-3}$ |
| ○ | 0.15 | 0.4 | $5.07 \times 10^{3}$ |
| ○ | 0.15 | 0.25 | $1.73 \times 10^{-3}$ |
| ○ | 0.15 | 0.2 | $1.09 \times 10^{3}$ |
| ◎ | 0.15 | 0.15 | $6.43 \times 10^{-4}$ |
| ○ | 0.15 | 0.12 | $4.46 \times 10^{-4}$ |
| ○ | 0.15 | 0.1 | $3.42 \times 10^{-4}$ |
| ○ | 0.15 | 0.075 | $2.38 \times 10^{4}$ |
| X | 0.15 | 0.07 | $2.20 \times 10^{4}$ |
| X | 0.15 | 0.05 | $1.58 \times 10^{-4}$ |
| X | 0.15 | 0.025 | $9.89 \times 10^{-5}$ |

TABLE 3

| Length of Flat Surface Portion (mm) | Radius (mm) | Cross-sectional Secondary Moment ($mm^4$) |
|---|---|---|
| 0.15 | 0.5 | $2.81 \times 10^{-4}$ |
| 0.15 | 0.4 | $2.25 \times 10^{4}$ |

TABLE 3-continued

| Length of Flat Surface Portion (mm) | Radius (mm) | Cross-sectional Secondary Moment ($mm^4$) |
|---|---|---|
| 0.15 | 0.25 | $1.41 \times 10^{-4}$ |
| 0.15 | 0.2 | $1.13 \times 10^{4}$ |
| 0.15 | 0.15 | $8.44 \times 10^{-5}$ |
| 0.15 | 0.12 | $6.75 \times 10^{5}$ |
| 0.15 | 0.1 | $5.63 \times 10^{-5}$ |
| 0.15 | 0.075 | $4.22 \times 10^{-5}$ |
| 0.15 | 0.07 | $3.94 \times 10^{-5}$ |
| 0.15 | 0.05 | $2.81 \times 10^{5}$ |
| 0.15 | 0.025 | $1.41 \times 10^{-5}$ |

As a result, a range of up to 0.8 (the error range is ±0.04) mm can be applied as the maximum diameter (d) of the small circular concave portion 20, a number of small circular concave portions 20 being able to be arranged in the inner surface of the conductor crimping portion 13 as the concave serrations. In addition, a range of up to 0.15 (the error range is ±0.04) mm can be applied as a minimum diameter (d).

For example, when an aluminum wire gets into a number of small circular concave portions 20 of the conductor crimping portion 13, it is predicted that the aluminum wire easily gets into the serrations including the small circular concave portions 20 because a Young's modulus of the aluminum wire is 70 GPa whereas a Young's modulus of a main material of the electrical wire (a Cu electrical wire) is 130 GPa. Since a most suitable diameter in the Cu electrical wire is 0.275 mm (approximately 0.3 mm), and the Young's modulus of the aluminum wire is lower than that of the Cu electrical wire by 54%, it is predicted that a most suitable diameter of the aluminum wire is also reduced more than the most suitable diameter of the Cu electrical wire in proportion to the lowering of the Young's modulus. Therefore, as the minimum diameter of the small circular concave portion 20, it is established that d=0.275×0.54=0.1485 mm (approximately 0.15 mm), the plural rows of small circular concave portions 20 being able to be arranged in the inner surface of the conductor crimping portion 13 as the concave serrations.

Second Embodiment

FIG. 8 is a cross-sectional view of the small circular concave portions 20 as the serration in a crimp terminal according to a second embodiment of the present invention.

In the crimp terminal of the present embodiment, the serration angle θ between the extension surface 21*a* of the inner bottom surface 21 and the inner side surface 22 of each small circular concave portion 20 is set to be 70 degrees.

The diameter "d" of the inner bottom surface of the small circular concave portion 20 is set to be 0.3 mm. The shortest distance "b" of a flat surface portion between peripheries of mutually adjacent small circular concave portions 20 is set to be 0.15 mm.

In this case, r1 and r2 of the model used for calculating a cross-sectional secondary moment have values of 0.15 mm and 0.3 mm, respectively. It is to be noted that a radius of a top surface of the concave portion 20 is not employed because a round is applied to the periphery thereof and the radius is difficult to measure.

By configuring the crimp terminal as described above, the cross-sectional secondary moment of serration portions can be effectively increased, and deformation of the serration angle in the state after crimping can be suppressed to be as small as possible. As a result of it, the stress that acts on the conductor Wa (element wire) of the electrical wire can be increased, and the relative sliding distance between the terminal 10 and the conductor Wa can be made longer, which improves the crimping performance much more.

Third Embodiment

Figure 11:
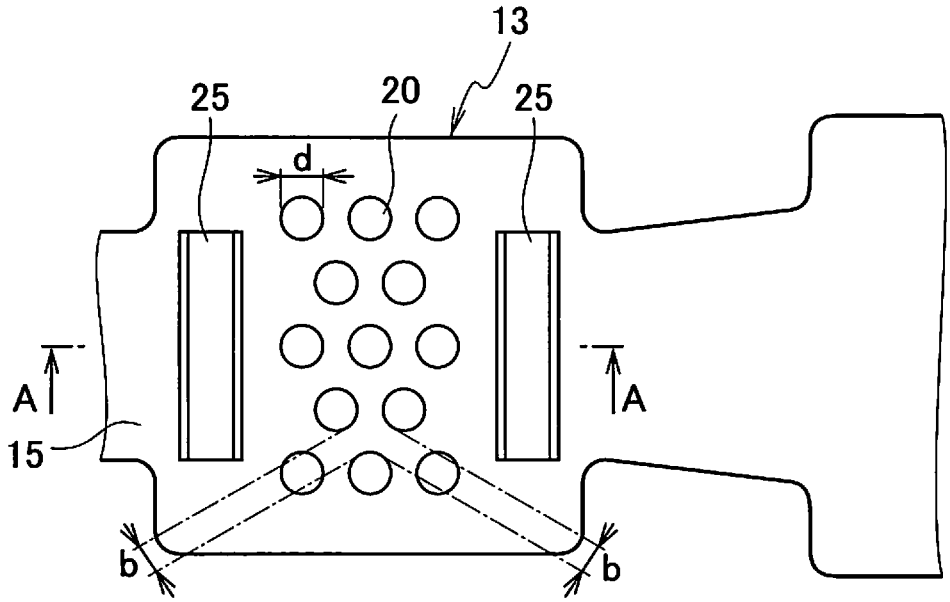
FIG. 11(*a*) is a plan view showing an expanded shape of a conductor crimping portion.
Figure 11:
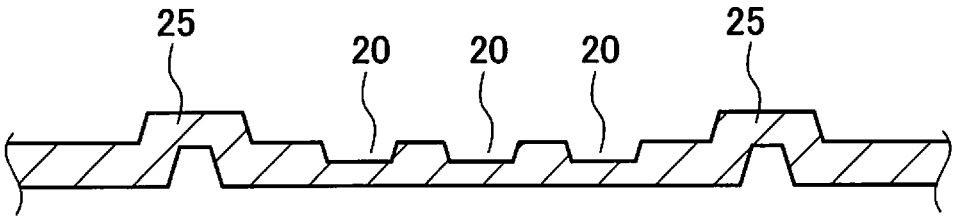

FIG. 11 is explanatory views of a crimp terminal according to a third embodiment of the present invention. Specifically, FIG. 11(*a*) is a plan view showing an expanded shape of a conductor crimping portion, and FIG. 11(*b*) is an arrow cross-sectional view taken along a line A-A of FIG. 11(*a*).

In the present embodiment, in order to reduce a size of the terminal, the number of small circular concave portions 20 provided as the serrations is less than that in the first embodiment.

In addition, linear convex portions 25 for restricting extension in a front-rear direction of the conductor of the electrical wire at the time of crimping are provided at a front and a rear of a region where the small circular concave portions 20 as the serrations are scattered, so as to intersect in a terminal width direction. The other configurations are similar to that of the first embodiment. Accordingly, the small circular concave portions 20 are provided similarly to the first embodiment, and thereby effects similar to the first embodiment can be obtained.

What is claimed is:

1. A crimp terminal comprising:

an electrical connection portion provided at a front of the crimp terminal in a terminal longitudinal direction; and a conductor crimping portion that is provided closer to a rear than the electrical connection portion in the terminal longitudinal direction, and is crimped and connected to a conductor of a terminal of an electrical wire, wherein the conductor crimping portion is formed to have a substantially U-letter shaped cross section, the conductor crimping portion has a bottom plate, and a pair of conductor crimping pieces that are extended upward from both left and right side edges of the bottom plate and that crimp the conductor of the electrical wire arranged on an inner surface of the bottom plate so as to wrap the conductor of the electrical wire, concave serrations are provided in an inner surface of the conductor crimping portion, a number of circular concave portions are provided in the inner surface of the conductor crimping portion as the concave serrations so as to be scattered in a state of being spaced aside from one another, in a state before the conductor crimping portion is crimped to the conductor of the electrical wire, a diameter of an inner bottom surface of each circular concave portion is set within a range of 0.15 (the error range is ±0.04) mm to 0.8 (the error range is ±0.04) mm, a serration angle between an extension surface of the inner bottom surface and an inner side surface of the each circular concave portion is set within a range of 60 to 90 degrees, and a shortest distance of a flat surface portion between peripheries of mutually adjacent circular concave portions is set to be 0.17 (the error range is ±0.09) mm.

2. The crimp terminal according to claim 1, wherein the diameter of the inner bottom surface of the each circular concave portion is set to be 0.3 (the error range is ±0.04) mm, the serration angle between the extension surface of the inner bottom surface and the inner side surface of the each circular concave portion is set to be 70 degrees, and the shortest distance of the flat surface portion between the peripheries of the mutually adjacent circular concave portions is set to be 0.15 mm.

* * * * *